US011774146B2

(12) United States Patent
Hasegawa et al.

(10) Patent No.: US 11,774,146 B2
(45) Date of Patent: Oct. 3, 2023

(54) TURBO COMPRESSOR AND CENTRIFUGAL CHILLER COMPRISING SAME

(71) Applicant: MITSUBISHI HEAVY INDUSTRIES THERMAL SYSTEMS, LTD., Tokyo (JP)

(72) Inventors: Yasushi Hasegawa, Tokyo (JP); Kenji Ueda, Tokyo (JP); Shintaro Omura, Tokyo (JP)

(73) Assignee: MITSUBISHI HEAVY INDUSTRIES THERMAL SYSTEMS, LTD., Tokyo (JP)

( * ) Notice: Subject to any disclaimer, the term of this patent is extended or adjusted under 35 U.S.C. 154(b) by 603 days.

(21) Appl. No.: 16/982,934

(22) PCT Filed: Mar. 19, 2019

(86) PCT No.: PCT/JP2019/011579
§ 371 (c)(1),
(2) Date: Sep. 21, 2020

(87) PCT Pub. No.: WO2019/188616
PCT Pub. Date: Oct. 3, 2019

(65) Prior Publication Data

US 2021/0010719 A1 Jan. 14, 2021

(30) Foreign Application Priority Data

Mar. 30, 2018 (JP) ..... 2018-069158

(51) Int. Cl.
*F25B 1/053* (2006.01)
*F04D 29/058* (2006.01)
*F25B 9/06* (2006.01)

(52) U.S. Cl.
CPC ..... *F25B 1/053* (2013.01); *F04D 29/058* (2013.01); *F25B 9/06* (2013.01)

(58) Field of Classification Search
CPC ..... F25B 1/053; F25B 9/06; F04D 29/058
See application file for complete search history.

(56) References Cited

U.S. PATENT DOCUMENTS

2015/0275911 A1* 10/2015 Carrasco ..... F04D 25/06 417/423.12
2017/0146271 A1* 5/2017 Hasegawa ..... F04D 29/582
(Continued)

FOREIGN PATENT DOCUMENTS

JP 63-92821 U 6/1988
JP 1-180016 U 12/1989
(Continued)

OTHER PUBLICATIONS

International Search Report and Written Opinion of the International Searching Authority for International Application No. PCT/JP2019/011579, dated Jun. 18, 2019, with English translation.

*Primary Examiner* — Elizabeth J Martin
(74) *Attorney, Agent, or Firm* — Birch, Stewart, Kolasch & Birch, LLP

(57) ABSTRACT

Provided are a turbo compressor and a centrifugal chiller comprising the same with which the length of a shaft in an axial direction can be shortened, rotational shake accompanying rotation of the shaft is suppressed, and a device can be made small. A turbo compressor comprising: a compressor part which compresses refrigerant; a shaft (15) which drives the compressor part around an axis of rotation X; a magnetic bearing (30A) which has provided thereto an iron core part (32) comprising a plurality of teeth parts (34) formed at equiangular intervals around the axis of rotation X, and, a plurality of coils (36) respectively wound around the plurality of teeth parts (34), and said magnetic bearing (30A) allows the shaft (15) to pass through and supports said shaft (15) without contacting the same; an auxiliary bearing which allows the shaft (15) to pass through; and a displacement
(Continued)

sensor (50) which detects displacement of the shaft (15), wherein the displacement sensor (50) is provided between neighboring coils (36).

7 Claims, 8 Drawing Sheets

(56) References Cited

U.S. PATENT DOCUMENTS

| | | | |
|---|---|---|---|
| 2019/0024667 | A1 | 1/2019 | Kawashima |
| 2019/0170151 | A1 | 6/2019 | Sakawaki et al. |

FOREIGN PATENT DOCUMENTS

| | | | |
|---|---|---|---|
| JP | 7-35089 | A | 2/1995 |
| JP | 2002-218708 | A | 8/2002 |
| JP | 2013-207864 | A | 10/2013 |
| JP | 2017-20520 | A | 1/2017 |
| JP | WO2018/033945 | A1 | 2/2018 |
| JP | 2018-105457 | A | 7/2018 |

* cited by examiner

TURBO COMPRESSOR AND CENTRIFUGAL CHILLER COMPRISING SAME

TECHNICAL FIELD

The present disclosure relates to a turbo compressor and a centrifugal chiller including the turbo compressor.

BACKGROUND ART

In order to rotatably support a shaft that rotationally drives a compression mechanism, a contact-type bearing such as a rolling bearing is adopted in some cases in a turbo compressor. In this case, there is a concern over a complicated structure caused by providing a lubricant system of a bearing and a mechanical loss caused by friction of the bearing.

For this reason, in order to omit the lubricant system and reduce the mechanical loss, a magnetic bearing that is a non-contact type bearing is adopted in some cases instead of the rolling bearing.

As a structure of a fluid machine using the magnetic bearing, for example, there is a structure disclosed in FIG. 3 of PTL 1. In this structure, an auxiliary bearing and a displacement sensor are provided on both sides of the magnetic bearing along an axial direction of a shaft.

CITATION LIST

Patent Literature

[PTL 1] Japanese Unexamined Patent Application Publication No. 2002-218708

SUMMARY OF INVENTION

Technical Problem

However, in the structure disclosed in PTL 1, since the magnetic bearing, an auxiliary bearing, and the displacement sensor are provided to be separated from each other along the axial direction of the shaft, the components occupy a wide area in the axial direction. For this reason, it is necessary to design the shaft to be long, and there is a possibility that rotational vibration accompanying the rotation of the shaft occurs. In addition, there is a possibility that a size of the fluid machine increases.

The present disclosure is devised in view of such circumstances, and an object thereof is to provide a turbo compressor and a centrifugal chiller including the turbo compressor, which can shorten a length of a shaft in an axial direction, can suppress rotational vibration accompanying rotation of the shaft, and can realize miniaturization of the device.

Solution to Problem

In order to solve the problems, a turbo compressor and a centrifugal chiller including the turbo compressor according to the present disclosure adopt the following means.

According to one aspect of the present disclosure, there is provided a turbo compressor including a compression portion that compresses a refrigerant, a shaft that, drives the compression portion about a rotational axis, a magnetic bearing that is provided with an iron core portion on which a plurality of teeth are formed at an equal angular interval about the rotational axis and a plurality of coils which are wound around the plurality of teeth respectively and supports the inserted shaft in a non-contact manner, an auxiliary bearing that allows the shaft to be inserted thereinto, and a displacement sensor that detects a displacement of the shaft. The displacement sensor is provided between the coils adjacent to each other.

In the turbo compressor of the aspect, the displacement sensor is provided between the coils adjacent to each other. In the configuration, since the displacement sensor can be accommodated in the iron core portion of the magnetic bearing, a portion occupied by the components in an axial direction of the shaft can be reduced, for example, compared to a case where the magnetic bearing and the displacement sensor are provided to be separated from each other along the axial direction of the shaft. Accordingly, since a length of the shaft in the axial direction can be shortened or a distance between the magnetic bearings can be shortened, rotational vibration accompanying the rotation of the shaft is suppressed when using the turbo compressor. In addition, the miniaturization of the turbo compressor can be realized.

In the turbo compressor according to the aspect of the present disclosure, the auxiliary bearing is accommodated in a bearing box attached to the iron core portion.

In the configuration of the turbo compressor of the aspect, since the bearing box accommodating the auxiliary bearing is attached to the iron core portion of the magnetic bearing, a distance between the magnetic bearing and the auxiliary bearing can be shortened. Accordingly, the length of the shaft in the axial direction can be shortened or the distance between the magnetic bearings can be shortened.

In the turbo compressor according to the aspect of the present disclosure, the auxiliary bearing is accommodated in the bearing box formed of the same material as the iron core portion.

In the configuration of the turbo compressor of the aspect, since the iron core portion of the magnetic bearing and the bearing box accommodating the auxiliary bearing are formed of the same material, a change in a gap between the auxiliary bearing and the bearing box in a case where temperatures of the auxiliary bearing and the bearing box have changed can be suppressed, and the gap between the auxiliary bearing and the bearing box can be prevented from being deviated from a range of a specification plan value.

In the turbo compressor according to the aspect of the present disclosure, a cooling flow passage that allows a gas refrigerant to flow therethrough toward the displacement sensor is further included.

In the configuration of the turbo compressor of the aspect, the displacement sensor can be cooled by a gas refrigerant as the cooling flow passage causes the gas refrigerant to flow toward the displacement sensor. For this reason, even in a case where there is a possibility that the displacement sensor is thermally affected due to heat generation by the coils, a temperature rise of the displacement sensor can be suppressed, and an increase in a measurement error caused by the temperature rise of the displacement sensor can be prevented.

According to another aspect of the present disclosure, there is provided a centrifugal chiller including the turbo compressor, a condenser that condenses a refrigerant compressed by the turbo compressor, an expansion mechanism that expands the refrigerant condensed by the condenser, and an evaporator that evaporates the refrigerant expanded by the expansion mechanism.

Advantageous Effects of Invention

In the turbo compressor and the centrifugal chiller including the turbo compressor according to the present disclosure, the length of the shaft in the axial direction can be shortened, rotational vibration accompanying the rotation of the shaft can be suppressed, and the miniaturization of the device can be realized.

DESCRIPTION OF EMBODIMENTS

Hereinafter, a turbo compressor according to an embodiment of the present disclosure will be described.

Figure 1:
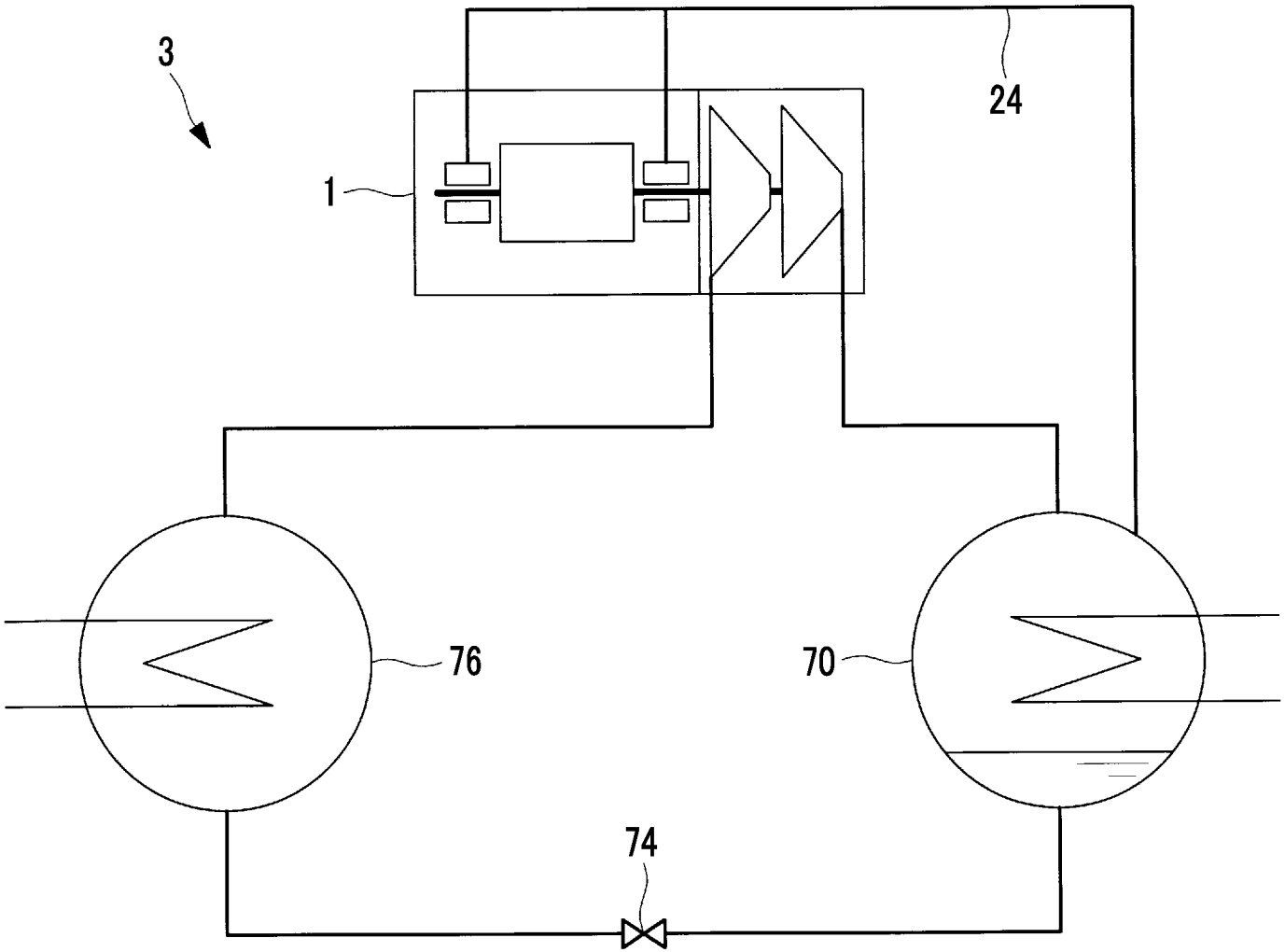
FIG. 1 is a diagram showing an example of a refrigerant circuit of a centrifugal chiller including a turbo compressor according to an embodiment of the present disclosure.

As shown in FIG. 1, a turbo compressor 1 is one of devices configuring a refrigerant circuit 3 of a centrifugal chiller. The refrigerant circuit 3 includes the turbo compressor 1, a condenser 70 that condenses a refrigerant compressed by the turbo compressor 1, an expansion valve 74 that expands the refrigerant condensed by the condenser 70, and an evaporator 76 that evaporates the refrigerant expanded by the expansion valve 74. The turbo compressor 1 is a turbo compressor that compresses a low-pressure gas refrigerant evaporated by the evaporator 76 to make into a high-temperature and high-pressure gas refrigerant.

Figure 2:
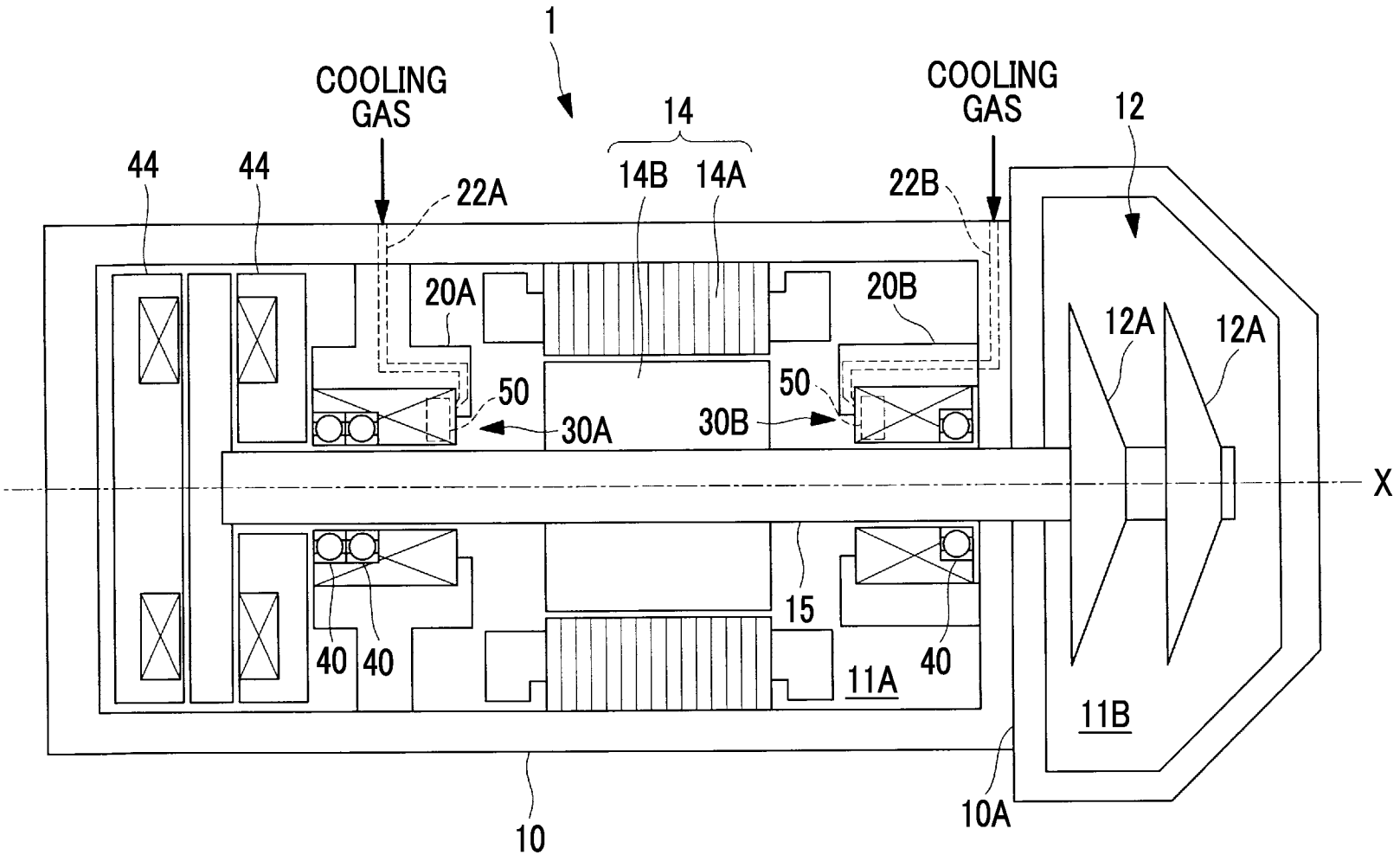
FIG. 2 is a vertical sectional view of the turbo compressor according to the embodiment of the present disclosure.

As illustrated in FIG. 2, the turbo compressor 1 is configured to include a casing 10 that forms an outer shell thereof, a compression portion 12 that has a plurality of impellers 12A, an electric motor 14, a shaft 15, and radial magnetic bearings (magnetic bearings) 30A and 30B, a plurality of auxiliary bearings 40, a thrust magnetic bearing 44, and displacement sensors 50.

The inside of the casing 10 is partitioned into an electric motor chamber 11A and a compression chamber 11B by a partition wall 10A.

The electric motor chamber 11A accommodates the electric motor 14, the radial magnetic bearings 30A and 30B, the auxiliary bearings 40, the displacement sensors 50, and the thrust magnetic bearing 44.

The compression chamber 11B accommodates the compression, portion 12 having the plurality of impellers 12A.

In addition, the shaft 15 extends in a rotational axis X direction (a right-and-left direction shown in FIG. 2), and are accommodated in the casing 10 across the electric motor chamber 11A and the compression chamber 11B by penetrating the partition wall 10A.

The electric motor 14 is configured to include a stator 14A that is fixed to an inner peripheral surface of the casing 10 and a rotor 14B that is fixed to an outer peripheral surface of the shaft 15 and rotates about a rotational axis X on an inner peripheral side of the stator 14A.

As described above, the shaft 15 is provided across the electric motor chamber 11A and the compression chamber 11B by penetrating the partition wall 10A, and one end thereof projects to a compression chamber 11B side. Further, the compression portion 12 is configured such that the plurality of impellers 12A are attached to the one end on the compression chamber 11B side to integrally rotate about the rotational axis X.

Out of the radial magnetic bearings 30A and 30B, the radial magnetic bearing 30B is disposed between the electric motor 14 and the partition wall 10A, and the radial magnetic bearing 30A is disposed on an opposite side to the radial magnetic bearing 30B with respect to the electric motor 14. In addition, the radial magnetic bearings 30A and 30B are fixed and supported with respect to the casing 10 by being supported by magnetic bearing support structures 20A and 20B respectively, which are connected to the casing 10. By energizing the radial magnetic bearings 30A and 30B, the radial magnetic bearings 30A and 30B support the shaft 15 so as to be rotatable about the rotational axis X in a non-contact manner. In addition, the thrust magnetic bearing 44 is provided to sandwich a disk-shaped thrust plate provided at the other end of the shaft 15 (an end portion on an opposite side to the compression portion 12), and restricts movement of the shaft 15 in the rotational axis X direction in a non-contact manner.

In addition to the radial magnetic bearings 30A and 30B, the plurality of auxiliary bearings 40 are provided.

The auxiliary bearings 40 are so-called touchdown bearings that, support the shaft 15 instead of the radial magnetic bearings 30A and 30B and the thrust magnetic bearing 44 which have lost a non-contact supporting function when the energization of the radial magnetic bearings 30A and 30B and the thrust magnetic bearing 44 is stopped.

When the shaft 15 is supported in a non-contact manner by the radial magnetic bearings 30A and 30B and the thrust magnetic bearing 44, the auxiliary bearings 40 are also not in contact with the shaft 15. At this time, a bearing clearance between the auxiliary bearings 40 and the shaft 15 is set to be smaller than a bearing clearance between the radial magnetic bearing 30A or 30B and the shaft 15. Accordingly, even when the shaft 15 is supported by the auxiliary bearings 40 instead of the radial magnetic bearings 30A and 30B and the thrust magnetic bearing 44, the bearing clearance between the radial magnetic bearing 30A or 30B and the shaft 15 and the bearing clearance between the thrust magnetic bearing 44 and the shaft remain. Thus, damage to the radial magnetic bearings 30A and 30B and the thrust magnetic bearing 44 is avoided.

In addition, the casing 10 accommodates the displacement sensors 50 that measure a displacement of the shaft 25 in a radial direction, and the vibration of the rotating shaft 15 is monitored.

Next, a structure of the radial magnetic bearing 30A, the disposition of the displacement sensors 50, and a support structure of the auxiliary bearing 40 will be described.

Figure 3:
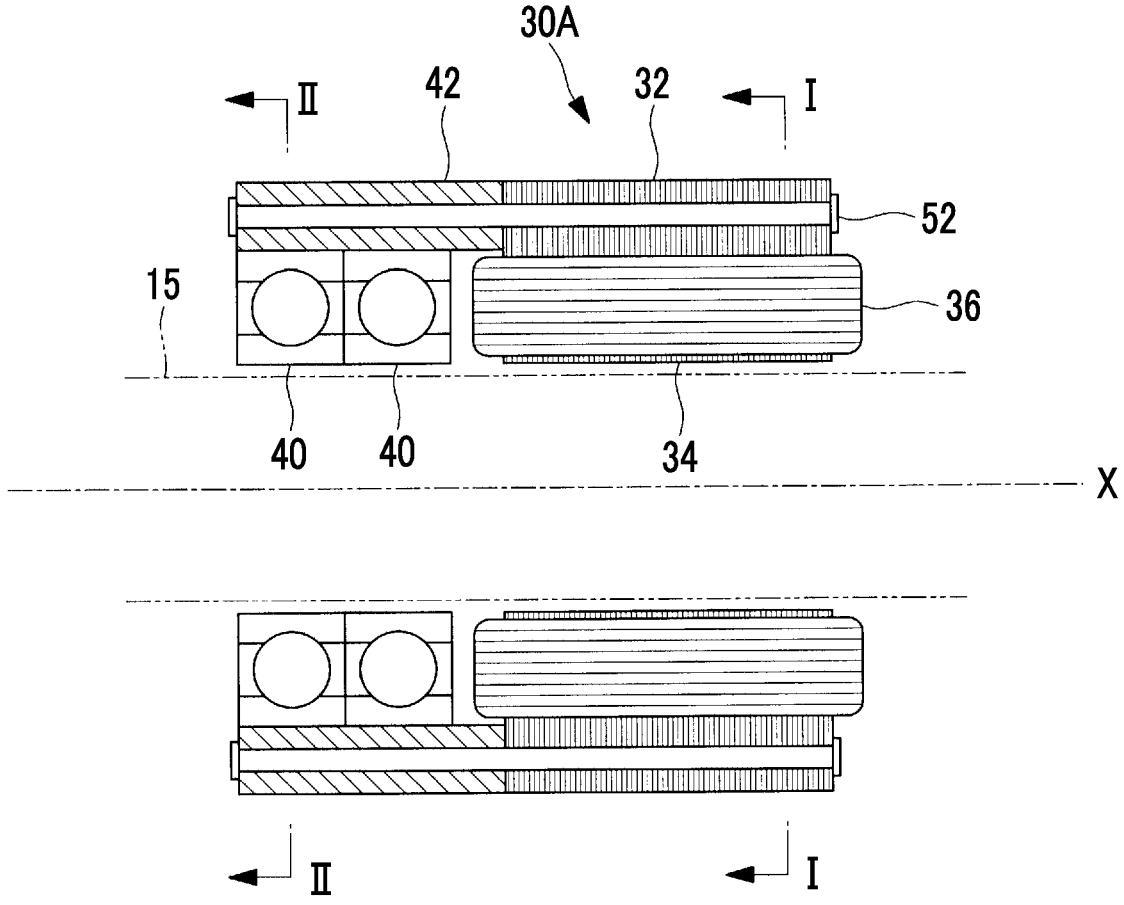
FIG. 3 is an enlarged view illustrating a structure around a magnetic bearing included in the turbo compressor according to the embodiment of the present disclosure.
Figure 4:
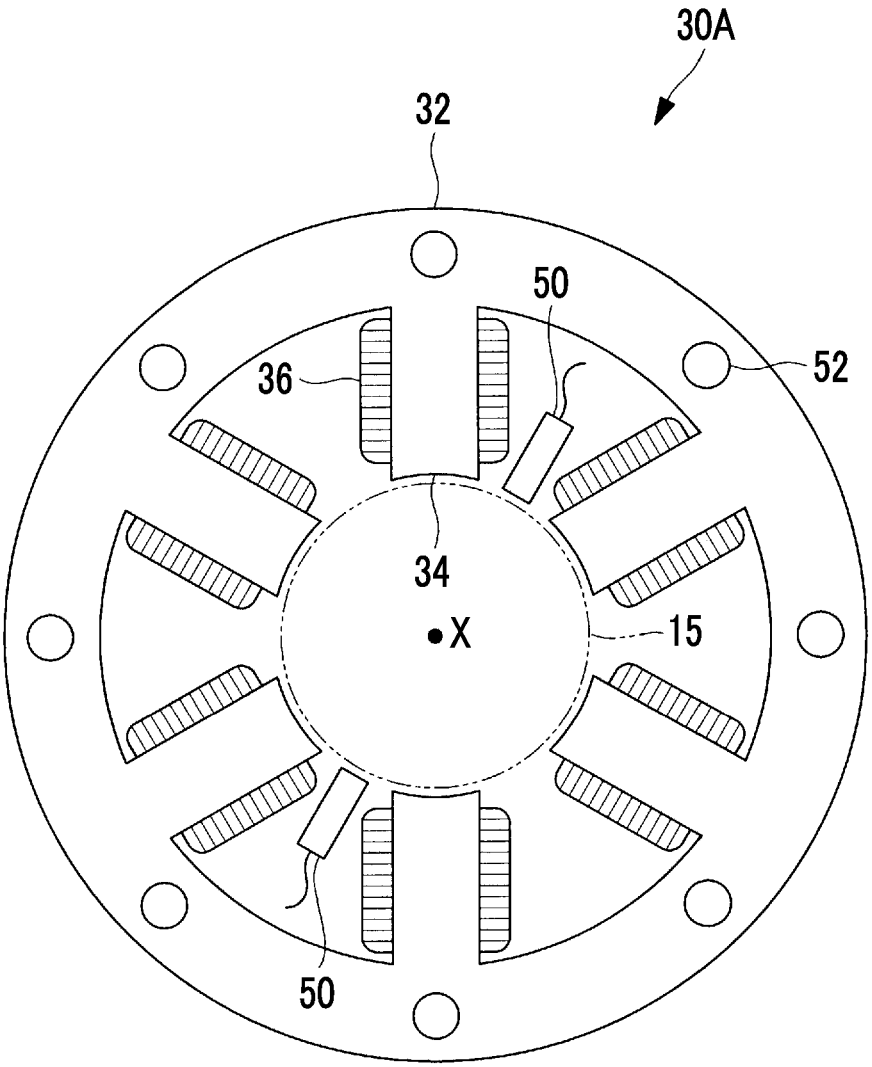
FIG. 4 is a sectional view taken along cutting line I-I of FIG. 3.

As illustrated in FIG. 3, the radial magnetic bearing 30A is configured to include a lay-up steel panel-shaped iron core portion 32 and coils 36. As illustrated in FIG. 4, the shaft 15 is inserted on the inner peripheral side of the iron core portion 32. In addition, on the inner peripheral side of the iron core portion 32, a plurality of teeth 34 are formed at equal angular intervals about the rotational axis X of the inserted shaft 15. Although the six teeth 34 are formed in FIG. 4, the number is not limited to six. The number may be five or less, or may be seven or more.

The coil 36 is wound around each of the teeth 34. A magnetic force is generated in the teeth 34 as the coils 36 are energized, and the shaft 15 is supported by the magnetic force in a non-contact manner.

In the radial magnetic bearing 30A of the turbo compressor 1 of the embodiment, the displacement sensor 50 is provided between the coils 36 adjacent to each other. In view of the fact that a space is generated between the coils 36 adjacent to each other in a circumferential direction, the radial magnetic bearing accommodates the displacement sensor 50 in the space. That is, the displacement sensor 50 is accommodated without protruding from the iron core portion 32 in the rotational axis X direction of the shaft 15 (refer to FIG. 2).

Figure 5:
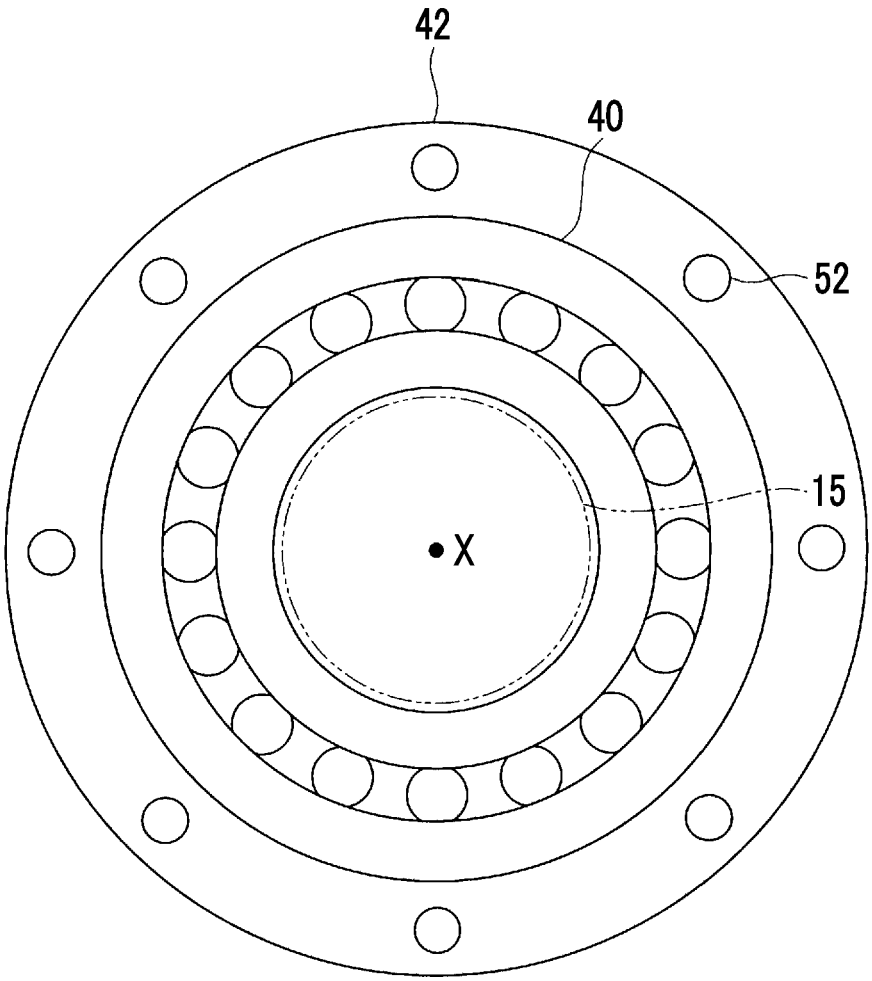
FIG. 5 is a sectional view taken along cutting line II-II of FIG. 3.

As illustrated in FIG. 3, the auxiliary bearings 40 each are provided such that an outer peripheral surface of an outer ring thereof is attached to the iron core portion 32 and is fitted to an inner peripheral surface of a thick cylindrical bearing box 42 which extends along the rotational axis X. As described above, the shaft 15 is inserted in the auxiliary bearings 40 with a predetermined bearing clearance provided with respect to the auxiliary bearings 40 (refer to FIG. 5).

Although the two auxiliary bearings 40 are provided in the bearing box 42 in FIG. 3, the number is not limited to two. The number may be one, or may be three or more.

The bearing box 42 and the iron core portion 32 are fixed by a fastening member 52. The fastening member 52 is a rod-shaped member that penetrates the bearing box 42 and the iron core portion 32 and extends in the rotational axis X direction. The fastening member 52 is, for example, a rivet. Although eight rivets are fixed in FIGS. 4 and 5, the number is not limited to eight. The number may be seven or less, or may be nine or more. The bearing box 42 may be made of the same material as the iron core portion 32.

Although the radial magnetic bearing 30A and a structure around the radial magnetic bearing have been described hereinbefore, also the radial magnetic bearing 30B has the same structure as the radial magnetic bearing 30A. Thus, description thereof will be omitted herein.

Next, cooling flow passages 22A and 22B illustrated in FIG. 2 will be described.

As mechanisms for cooling the displacement sensor 50 toward the displacement sensor 50 provided between the coils 36 adjacent to each other, the cooling flow passages 22A and 22B illustrated in FIG. 2 are provided in the turbo compressor 1 of the embodiment.

The cooling flow passages 22A and 22B are thin and long flow passages formed across the casing 10 and the magnetic bearing support structures 20A and 20B. One end of each of the cooling flow passages 22A and 22B on a casing 10 side communicates with an outside of the casing 10 (the turbo compressor 1). In addition, the other end of each of the cooling flow passages 22A and 22B is formed to face the displacement sensor 50. By supplying a cooling gas from the outside to the one end of each of the cooling flow passages 22A and 22B, the cooling gas can be jetted from the other end of each of the cooling flow passages 22A and 22B toward a surface of the displacement sensor 50 which is accommodated in each of the radial magnetic bearings 30A and 30B via the cooling flow passages 22A and 22B, the surface being a surface intersecting the rotational axis X direction, more specifically, a surface orthogonal to the rotational axis X direction.

As shown in FIG. 1, the cooling gas supplied to the one end of each of the cooling flow passages 22A and 22B can set a gas phase portion of the condenser 70 that configures the refrigerant circuit 3 of the centrifugal chiller in which the turbo compressor 1 is provided as a supply source. The cooling gas taken out from the gas phase portion of the condenser 70 is guided to the cooling flow passages 22A and 22B via a supply path 24.

Figure 6:
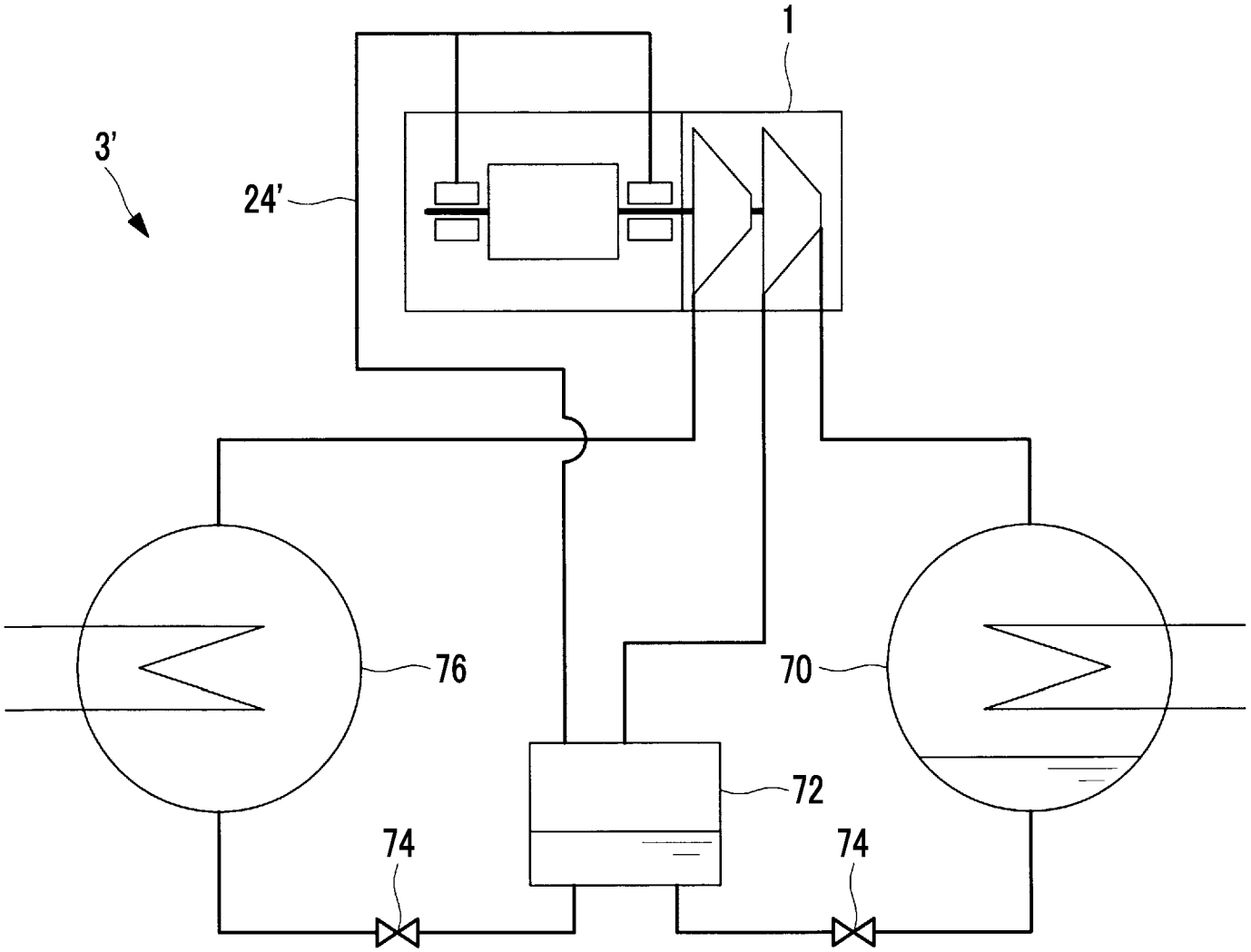
FIG. 6 is a diagram showing another example of the refrigerant circuit of the centrifugal chiller including the turbo compressor according to the embodiment of the invention.

As shown in FIG. 6, the cooling gas supplied to one end of each of the cooling flow passages 22A and 22B may set a gas phase portion of an economizer 72 that configures a refrigerant circuit 3' of the centrifugal chiller in which the turbo compressor 1 is provided as a supply source. The cooling gas taken out from the gas phase portion of the economizer 72 is guided to the cooling flow passages 22A and 22B via a supply path 24'.

Figure 7:
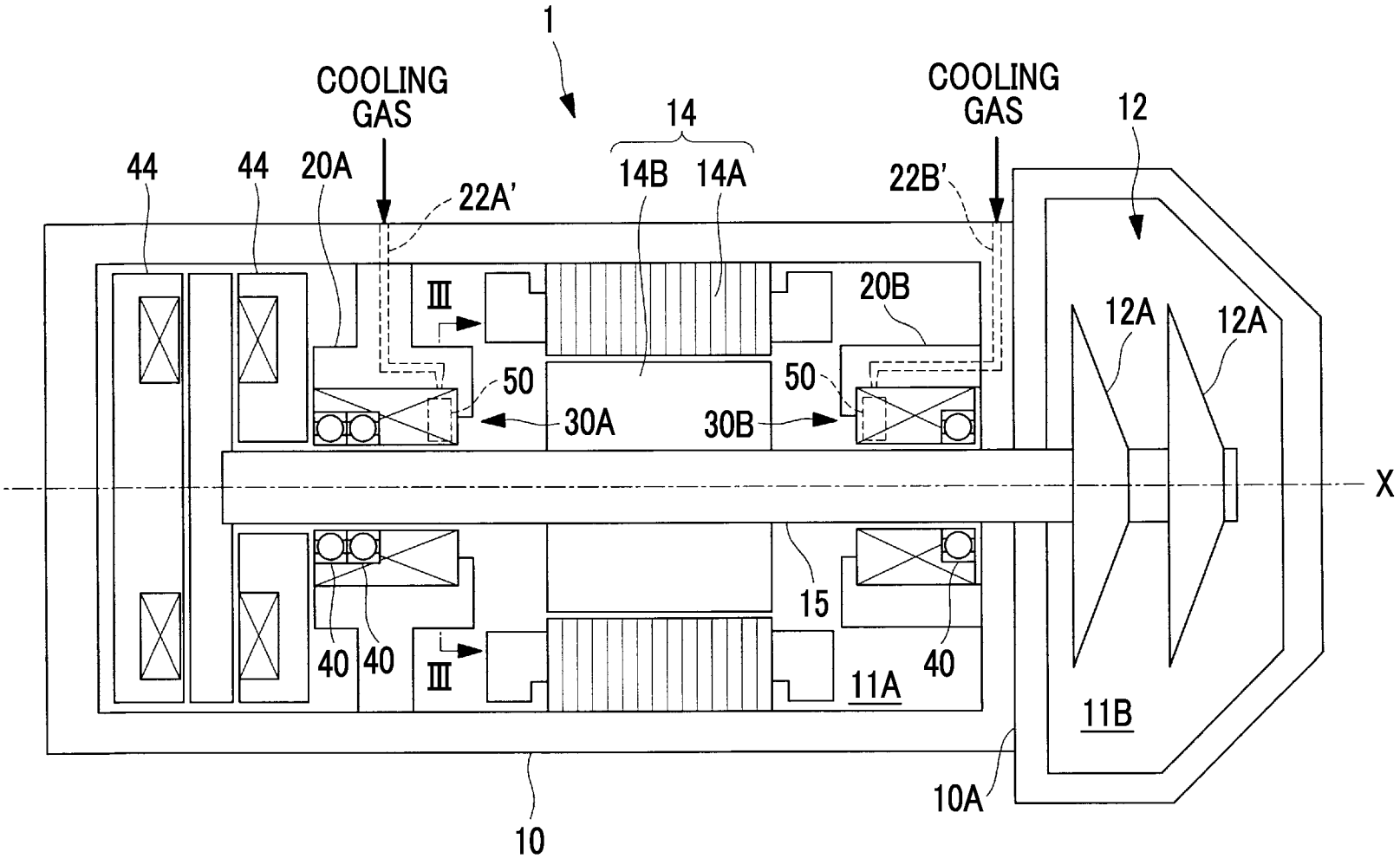
FIG. 7 is a vertical sectional view of a modification example of the turbo compressor according to the embodiment of the present disclosure.
Figure 8:
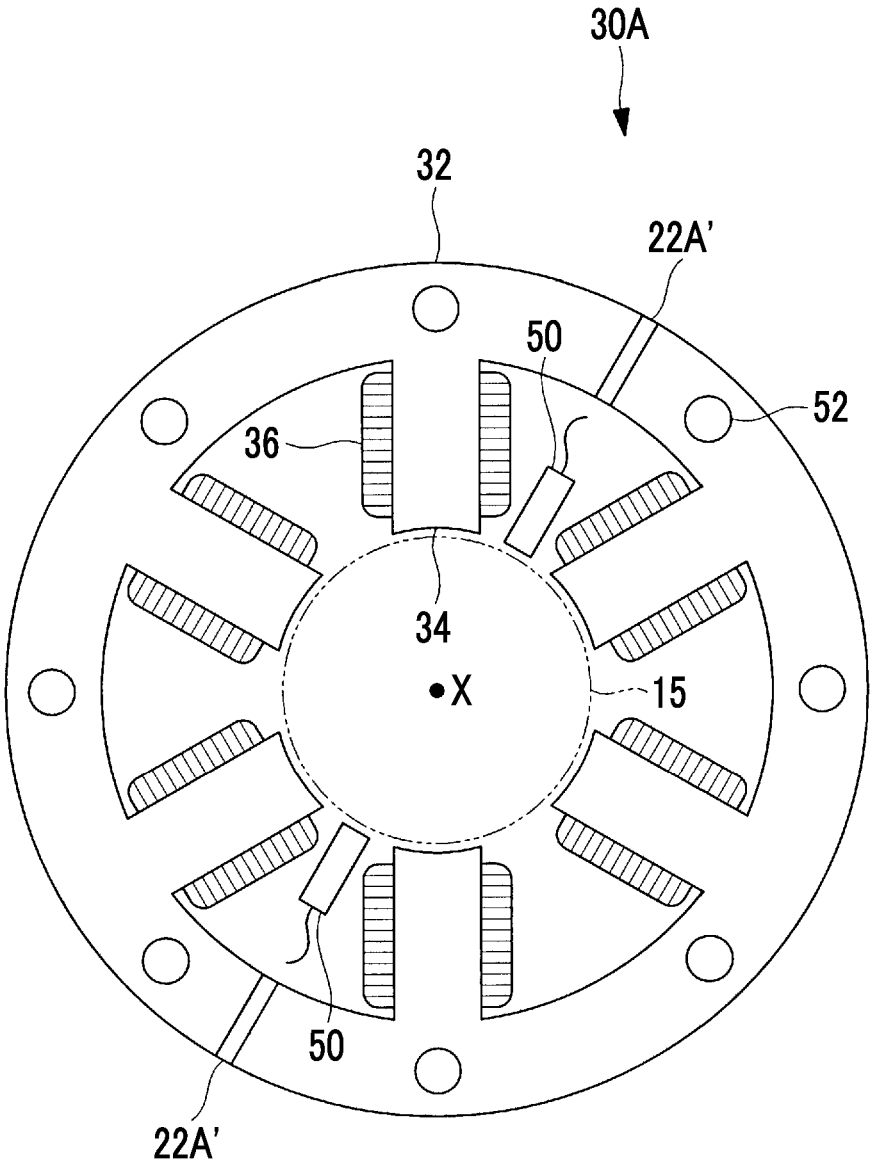
FIG. 8 is a sectional view taken along cutting line III-III of FIG. 7.

As modification examples of the cooling flow passages 22A and 22B, cooling flow passages 22A' and 22B' illustrated in FIG. 7 may be formed. The cooling flow passages 22A' and 22B' can not only jet the cooling gas toward the surfaces of the displacement sensors 50 intersecting the rotational axis X direction, more specifically, the surfaces orthogonal to the rotational axis X direction just as the cooling flow passages 22A and 22B (refer to FIG. 2) but also can jet the cooling gas toward a surface on an opposite side to surfaces of the displacement sensors 50 facing the shaft 15, that is, toward the inner peripheral side from an outer peripheral side of the iron core portion 32, as illustrated in FIG. 8.

The cooling flow passages 22A, 22B, 22A', and 22B' shown in FIGS. 2 and 7 are merely examples, and may be flow passages that are configured such that a cooling gas can flow from the outside of the turbo compressor 1 to the displacement sensors 50.

The embodiment has the following effects.

The displacement sensor 50 is provided between the coils 36 adjacent to each other. In the configuration, since the displacement sensors 50 can be accommodated inside the iron core portion 32, a portion occupied by the components in the rotational axis X direction of the shaft 15 can be reduced, for example, compared to a case where the radial magnetic bearings 30A and 30B and the displacement sensors 50 are provided to be separated from each other along the rotational axis X direction of the shaft 15. Accordingly, since a length of the shaft 15 in the rotational axis X direction can be shortened or a distance between the radial magnetic bearing 30A and the radial magnetic bearing 30B can be shortened, rotational vibration accompanying the rotation of the shaft 15 is suppressed when the turbo compressor 1 is operated. In addition, the miniaturization of the turbo compressor 1 can be realized.

In addition, since the bearing box 42 accommodating the auxiliary bearings 40 is attached to the iron core portion 32 of each of the radial magnetic bearings 30A and 30B, a distance between the radial magnetic bearing 30A or 30B and the auxiliary bearing 40 can be shortened. Accordingly, the length of the shaft 15 in the rotational axis X direction can be shortened or the distance between the radial magnetic bearing 30A and the radial magnetic bearing 30B can be shortened.

In addition, the displacement sensors 50 can be cooled by a gas refrigerant by jetting the gas refrigerant toward the displacement sensors 50 via the cooling flow passages 22A, 22B, 22A', and 22B'. For this reason, even in a case where there is a possibility that the displacement sensors 50 are thermally affected due to heat generation by the coils 36, temperature rises of the displacement sensor 50 can be suppressed, and an increase in a measurement error caused by the temperature rises of the displacement sensors 50 can be prevented.

REFERENCE SIGNS LIST

1 turbo compressor
3, 3' refrigerant circuit
10 casing
11A partition wall
11A electric motor chamber
11B compression chamber
12 compression portion
12A impeller
14 electric motor
14A stator
14B rotor
15 shaft
20A, 20B magnetic bearing support structure
22A, 22B, 22A', 22B' cooling flow passage
30A, 30B radial magnetic bearing (magnetic bearing)
32 iron core portion
34 teeth
36 coil
40 auxiliary bearing
42 bearing box
44 thrust magnetic bearing
50 displacement sensor
52 fastening member
X rotational axis

The invention claimed is:

1. A turbo compressor comprising:
a compression portion that compresses a refrigerant;
a shaft that drives the compression portion about a rotational axis;
a casing that accommodates the compression portion and the shaft;
a magnetic bearing that is provided with an iron core portion which is accommodated in the casing and on which a plurality of teeth are formed at an equal angular interval about the rotational axis and a plurality of coils which are wound around the plurality of teeth respectively and supports the inserted shaft in a non-contact manner;
an auxiliary bearing that allows the shaft to be inserted thereinto; and
a displacement sensor that detects a displacement of the shaft,
wherein the auxiliary bearing is accommodated in a bearing box formed of the same material as the iron core portion; and
the displacement sensor is provided between the coils adjacent to each other.

2. The turbo compressor according to claim 1,
wherein the auxiliary bearing is accommodated in the bearing box attached to the iron core portion.

3. The turbo compressor according to claim 2, further comprising:
a cooling flow passage that allows a gas refrigerant to flow therethrough toward the displacement sensor.

4. A centrifugal chiller comprising:
the turbo compressor according to claim 2;
a condenser that condenses a refrigerant compressed by the turbo compressor;
an expansion mechanism that expands the refrigerant condensed by the condenser; and
an evaporator that evaporates the refrigerant expanded by the expansion mechanism.

5. The turbo compressor according to claim 1, further comprising:
a cooling flow passage that allows a gas refrigerant to flow therethrough toward the displacement sensor.

6. A centrifugal chiller comprising:
the turbo compressor according to claim 5;
a condenser that condenses a refrigerant compressed by the turbo compressor;
an expansion mechanism that expands the refrigerant condensed by the condenser; and
an evaporator that evaporates the refrigerant expanded by the expansion mechanism.

7. A centrifugal chiller comprising:
the turbo compressor according to claim 1;
a condenser that condenses a refrigerant compressed by the turbo compressor;
an expansion mechanism that expands the refrigerant condensed by the condenser; and
an evaporator that evaporates the refrigerant expanded by the expansion mechanism.

* * * * *